US007129648B2

(12) United States Patent
Fischer et al.

(10) Patent No.: US 7,129,648 B2
(45) Date of Patent: Oct. 31, 2006

(54) INTERFACE CIRCUIT FOR OPERATING CAPACITIVE LOADS

(75) Inventors: Klaus Fischer, Friedberg (DE); Josef Kreittmayr, Bobingen (DE)

(73) Assignee: Patent-Treuhand-Gesellschaft fur Elektrisch Gluhlampen mbH(DE)

( * ) Notice: Subject to any disclaimer, the term of this patent is extended or adjusted under 35 U.S.C. 154(b) by 87 days.

(21) Appl. No.: 10/810,727

(22) Filed: Mar. 29, 2004

(65) Prior Publication Data

US 2004/0195977 A1 Oct. 7, 2004

(30) Foreign Application Priority Data

Apr. 4, 2003 (DE) ..... 103 15 473

(51) Int. Cl.
*H05B 37/00* (2006.01)

(52) U.S. Cl. ..... 315/224; 315/244; 315/DIG. 4

(58) Field of Classification Search ..... 315/224, 315/307

See application file for complete search history.

(56) References Cited

U.S. PATENT DOCUMENTS 4,876,497 A 10/1989 Colver ..... 323/211
6,054,815 A * 4/2000 Sugita et al. ..... 315/244
6,713,974 B1 * 3/2004 Patchornik et al. ..... 315/295

FOREIGN PATENT DOCUMENTS

EP 10022078 1/1998
EP 1 045 623 A2 10/2000
EP 2001052886 2/2001

OTHER PUBLICATIONS

Copy of European Patent Office Search Report (dated Oct. 31, 2005; 3 pages total) for related European Patent Application No. EP 04 00 6568.

* cited by examiner

*Primary Examiner*—David Vu
(74) *Attorney, Agent, or Firm*—Fitch, Even, Tabin & Flannery

(57) ABSTRACT

An interface circuit suitable for operating capacitive loads such as electric ballasts for lamps at a mains supply circuit, in particular a phase gating dimmer. The interface circuit short-circuits the load input if the mains supply circuit does not carry out a load supply.

2 Claims, 4 Drawing Sheets

-- PRIOR ART --
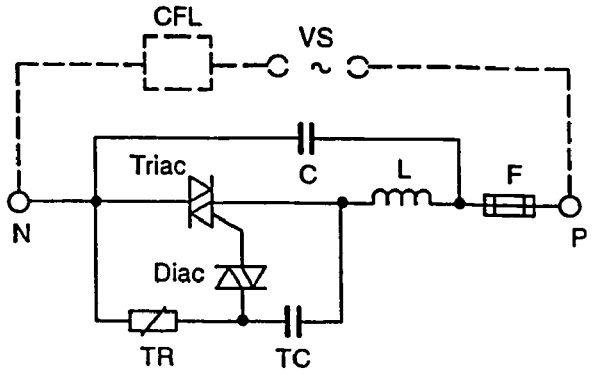
FIG. 1
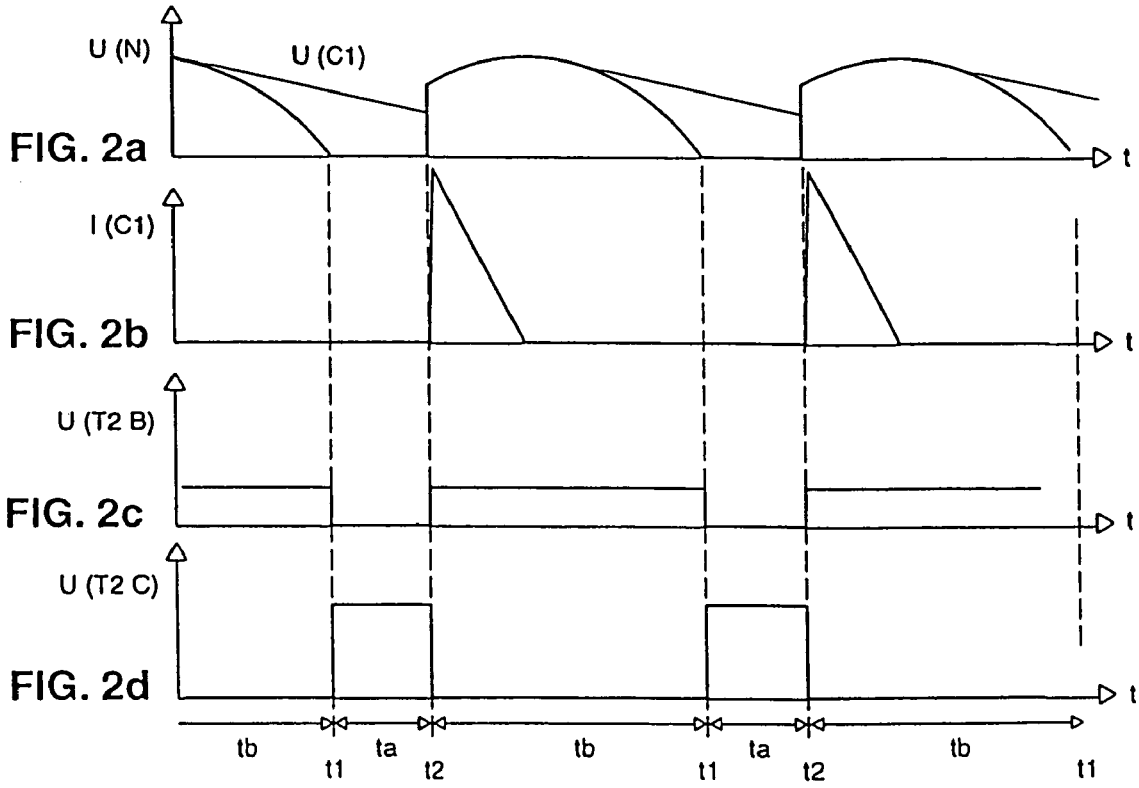

INTERFACE CIRCUIT FOR OPERATING CAPACITIVE LOADS

TECHNICAL FIELD

The invention relates to a circuit arrangement for operating capacitive loads at the mains using the example of electrical ballasts for lamps, in particular low pressure discharge lamps.

BACKGROUND ART

Circuit arrangements for operating low pressure discharge lamps are known in diverse embodiments. Generally, they contain a rectifier circuit for rectifying an AC voltage supply and for charging a capacitor, which is often referred to as a smoothing capacitor. The DC voltage present across this capacitor serves for supplying an inverter which operates the low pressure discharge lamp. Similar configurations are also known for other types of lamps, for example in the form of electronic transformers for halogen lamps. The invention furthermore quite generally relates to circuit arrangements for operating capacitive loads, the term "capacitive" meaning the so-called smoothing capacitor at the input of the inverter. Capacitive loads are intended to be understood hereafter as, in particular, such lamps which are equipped with an electrical ballast having capacitive properties.

DISCLOSURE OF THE INVENTION

The invention is based on the technical problem of specifying a circuit arrangement for operating at capacitive loads at the mains which provides extended possibilities of use for the loads, to be precise in particular for electrical lamps.

For this purpose, the invention provides an interface circuit for operating a capacitive load at a mains supply circuit, in particular a phase gating dimmer, wherein the interface circuit has a first switch, which is designed to short-circuit the input of the load if a mains supply to the input of the load is not effected.

By way of example, the invention is directed at an electronic ballast for a lamp with an integrated interface circuit of the abovementioned type for operating the lamp at a phase gating dimmer. The lamp is preferably a low pressure discharge lamp, but the invention can be applied to other types of lamps, such as e.g. high pressure discharge lamps or halogen lamps.

The inventors proceeded from the insight that the possibilities of dimming or of power regulation in the case of capacitive loads are worthy of improvement. In particular, capacitive loads such as low pressure discharge lamps (CFL) which are operated at mains supply circuits tend toward instabilities when the power supply is not constant, such as e.g. in the case of dimming. In the case of CFLs, for example, this is manifested by flickering, which is generally perceived as disturbing.

Although CFLs have hitherto also made use of complex pump circuits (known as circuits for reducing the mains current harmonics) which enable longer current conduction angles, that is to say a temporarily stabilized current consumption, and thus also improved dimming possibilities, what has a particularly disturbing effect in this case is that said pump circuits necessitate a high outlay on components and also a significantly more complex radio interference suppression. What is also disadvantageous here is that the pump circuits used have to be designed in such a way that during the operation of these lamps without a dimmer, the mains current harmonics that occur do not exceed the applicable limit values. A further disadvantage is that in the case of most pump circuits, the pump power depends on the instantaneous voltage of the DC voltage intermediate circuit and, consequently, asymmetries of the dimmer between two successive mains half-cycles can be amplified on account of positive feedback properties of the pump circuit used, which may lead to significant flicker phenomena.

The basic concept of the invention is to make the abovementioned capacitive loads compatible with dimmer circuits by means of an interface circuit and in doing so to avoid the abovementioned instabilities. In this case, the invention is directed in particular at operation at phase gating dimmers, which encounter difficulties in the case of capacitive loads on account of the temporally discontinuous current consumption of the capacitive load—specifically if the instantaneous value of the AC voltage present is greater than the voltage present across the capacitor. In this case, the interface circuit according to the invention is intended to enable a current flow through the phase gating dimmer in the remaining times as well, so that said current flows through a timing element contained in the dimmer.

For this purpose, a switch, preferably a first transistor, of the interface circuit is always switched on as soon as the mains AC voltage reaches its zero crossing. As an alternative, the transistor may also be switched on a short time after the zero crossing. The first switch is preferably immediately switched off again as soon as the instantaneous value of the mains voltage is applied to the load. As a result, in the case of use at a dimmer, it is possible that the current required for charging the dimmer-internal timing capacitor is defined only by the resistance of the dimmer timing element and can flow virtually unattenuated through the load. In particular, practically no additional current attenuation arises. The switch is preferably controlled by means of a second switch, preferably by means of a second transistor. Preferably, said second transistor is connected to the mains supply itself (that is to say before the rectification) at the load input via two resistors. As a result of this, the second transistor can practically "read out" the input voltage at the load and ascertain when a power supply is effected and the switch is to be switched on or off, without being disturbed in this case by the rectifier circuit or for instance filter capacitances.

The interface circuit according to the invention may furthermore have a control circuit, which evaluates a signal made available by the mains supply, preferably the supply voltage itself. For this purpose, by way of example, the duty ratio of the first transistor may be evaluated and a signal proportional thereto may be generated, which can be used for regulating the power consumption of the load.

A preferred refinement of this control circuit has a parallel circuit comprising a series circuit having a third resistor and a third transistor, the base of which is connected to the base of the first transistor, a second smoothing capacitor and a fourth resistor, the parallel circuit being connected in series with a fifth resistor, the tap of the control signal for the control of the power consumption of the load being provided between the fourth resistor and the fifth resistor. In this case, the fifth resistor may be connected in series with the said parallel circuit in parallel with the load. As an alternative, it is possible to integrate the fifth resistor for example in the inverter provided for supplying the load. In contrast to the first case, in which the fifth resistor must have a high resistance, in the latter case the fifth resistor may have a low resistance, so that voltage losses can be reduced. For elucidation, reference is made to the exemplary embodiment in accordance with FIG. 5.

The functional principle set forth above can be applied to all customary mains voltages independently of the actual input circuit of loads. It is suitable both for loads with a bridge rectification in the input and an individual filter or smoothing capacitance and for other input circuits having e.g. at least two diodes and at least two smoothing capacitors (so-called "3D-2C circuit", cf. FIG. 4*b*, or "voltage doubler", cf. FIG. 4*c*). In the case of the "2C-3D circuit", an arrangement comprising two capacitors and 3 diodes is used instead of an individual smoothing capacitor. In the case of the voltage doubler, two capacitors are connected via two diodes on the mains side and connected to the inverter circuit. As a result of this, overall double the peak mains voltage can be made available to the load, which makes it possible, for example, to operate lamps designed for a 220 V mains at a 110 V mains supply.

The interface circuit according to the invention may be embodied separately in its own housing in order to connect it for example in parallel with a plurality of capacitive partial loads at a dimmer. As a result, it is possible cost-effectively to operate a plurality of capacitive loads without an integrated interface function at a dimmer.

However, it may also advantageously be integrated with an electronic ballast and in particular in a compact fluorescent lamp.

BRIEF DESCRIPTION OF THE DRAWINGS

The invention will be explained in more detail below on the basis of a plurality of exemplary embodiments. In this case, the exemplary embodiments show the preferred use of the interface circuit for operation with a CFL at a phase gating dimmer. In the figures:

FIG. 1 shows a circuit of a conventional phase gating dimmer at which a capacitive load is operated, FIG. 2 shows the voltage-current profile for an interface circuit in accordance with FIG. 4*a*, where a) shows the profile of the mains voltage of the load, b) shows the charging current of a smoothing capacitor at the load, c) shows the control of the second transistor and d) shows the voltage profile at the collector of the second transistor as functions of time.

BEST MODE FOR CARRYING OUT THE INVENTION

An example of the use of the interface circuit according to the invention is shown in FIG. 1. This figure shows a circuit in which a compact fluorescent lamp CFL is operated by means of an AC voltage mains supply. The load CFL is supplied by this voltage source via a phase gating dimmer (between the points N and P). Phase gating dimmers supply a periodic mains supply to the load, which is released by the triggering of a power switch triac via a variable timing element diac, TR, TC. By virtue of the interface circuit according to the invention, the timing element can also operate in the nonconducting state of the power switch (that is to say if no mains voltage is applied to the load). The actual load is not present in the absence of a power supply for the timing element, so that the circuit arrangement of the actual load has no influence on the triggering operation of the power switch. It is thus possible to avoid the situation in which for instance phase shifts occur which shift the triggering instants in each mains half-cycle and, at the load, may ultimately lead to undesirable flicker phenomena or the like.

Figure 3:
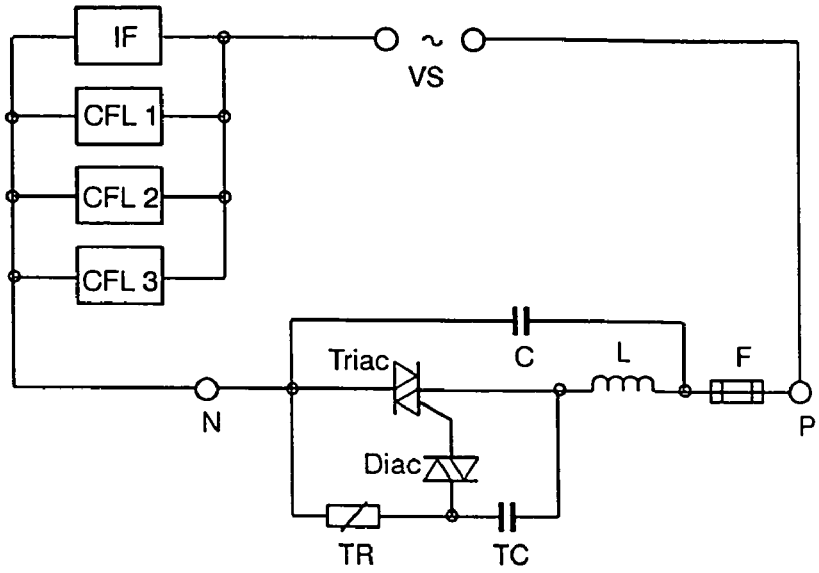
FIG. 3 shows a circuit arrangement according to the invention with a separate interface circuit.

In addition to the power switch Triac and the timing element formed from a diac, a capacitor TC and a variable resistor TR, the dimmer circuit is usually also provided with a fuse F and, for smoothing and radio interference suppression, additionally a capacitor C and an inductance L. The interface circuit may be integrated into the ballast of the lamp CFL; this embodiment can be seen in detail in FIGS. 4*a* and 4*b*. The load CFL may also be operated with a separate interface circuit. FIG. 3 diagrammatically shows such a construction for the operation of a plurality of lamps CFL (CFL1, CFL2, CFL3) at a single dimmer using a separate interface circuit IF.

The function of the interface circuit is described with reference to FIG. 4*a*, which shows an exemplary circuit construction which realizes the functional principle described above.

The mains AC voltage is converted into a pulsating DC voltage in a rectifier GL.

A capacitor C1 is charged via a diode D1 and the rectifier GL to the peak value of the input voltage applied to the load and makes available for example to an inverter INV, which is not described in any greater detail, a DC voltage which is converted in said inverter into a high-frequency AC voltage for supplying a low pressure discharge lamp CFL with a predeterminable lamp current.

In the example shown in FIG. 4, the interface circuit IF according to the invention is formed by the resistors R1, R2, R3, R4, the diode D1, the resistors R5, R6, and the transistors T1 and T2. The switching path of the first transistor T1 runs in series with the diode D1 in parallel with the smoothing capacitor C1, which supplies the voltage required for the inverter circuit INV for generating a high-frequency AC voltage for the lamp CFL. The transistor short-circuits the supply inputs of the load. A second transistor T2 serves for switching the transistor T1 on or off and is connected by its collector (via a resistor R5) to the base of the transistor T1. In this case, the switching path of the second transistor T2 runs in parallel with the series circuit comprising the resistor R5 and the control path of the first transistor T1 (T2 thus switches T1 off and on). Thus, the first transistor can be switched off by the second transistor being switched on.

The method of operation of the circuit is as follows: the transistor T1 forms, in the switched-on state, via the bridge rectifier GL, a short circuit between the two mains input terminals. The polarity of the diode D1 prevents the transistor T1 from also short-circuiting the capacitor C1 in the switched-on state. Arranging the transistor T1 at the output of the bridge rectifier GL has the effect of reducing the input impedance of the load (CFL) to a minimum ("short circuit") both in the case of positive and in the case of negative half-cycles of the mains AC voltage (VS, see FIG. 1).

With the resistors R1, R2 and R3, an image of the instantaneous input voltage of the circuit is formed and applied to the base of the transistor T2 via the resistor R4.

The arrangement of the resistors R1 and R2, which are connected on the mains side according to the invention, ensures that the zero crossings of the mains input voltage (reversal of the polarity of VS) can be detected reliably and independently of possibly present filter capacitances or else parasitic capacitances.

The transistor T1 is switched on via the resistors R5 and R6 with transistor T2 switched off. However, it is possible for T1 to be switched on, instead of by C1, via R6 and R5, also by means of a time-continuous signal available in the load or the inverter INV (for example the supply of a control IC present in the inverter INV).

If T2 is switched on by a positive, sufficiently large voltage drop at R3 via R4, the transistor T1 is switched off. In this case, the resistors R4 and R5 serve to improve the switching behavior of T2 and T1.

What is achieved by the inverting function of T2 is that T1 is always switched on during the time ta (cf.

FIG. 2), in which the instantaneous value of the mains AC voltage VS is present across the dimmer and the triac provided as switching element in the dimmer is nonconducting. As soon as the triac in the dimmer is triggered (instant t2 in FIG. 2) and the instantaneous value of the mains AC voltage VS is thereby applied to the load (CFL), T1 is switched off and the capacitor C1 is charged via D1 to the peak value of the input voltage of the load (CFL) (cf. time tb in FIG. 2*b*).

The transistor T1 used may be a low-power transistor which must admittedly have a breakdown voltage greater than the maximum mains voltage VS, but of which no critical requirements whatsoever are made with regard to the current-carrying capacity and current gain.

The transistor T2 operating as a switching transistor is usually operated with a small base/emitter voltage of about 0.6 V. This voltage is temperature-dependent, however, so that the switching voltage may vary (for example between 0.4 V and 0.6 V) on account of the operation of the circuit and the change in temperature associated therewith. Measures which compensate for the temperature-dependent fluctuation of the control voltage could therefore be implemented, if appropriate.

Figure 4A:
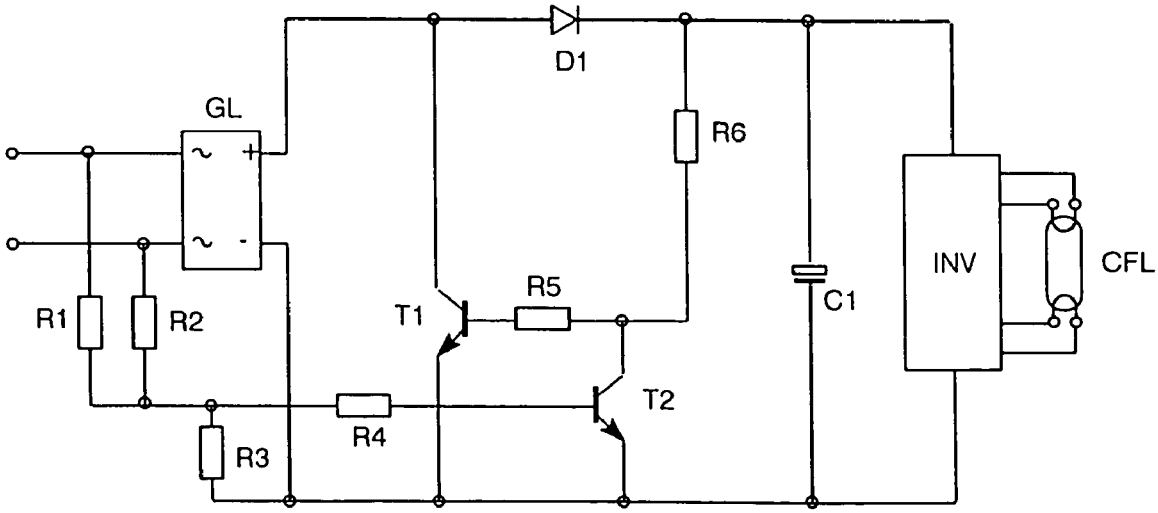
FIG. 4*a* shows an exemplary construction for an interface circuit according to the invention.

By way of example, for this purpose, a zener diode may be connected in series with the resistor R4 shown in FIG. 4*a*. It is thereby possible to increase the voltage (for example around 20 V) dropped across R3, with the result that the relative fluctuation of the voltage required for switching on the transistor T2 is reduced.

Figure 4B:
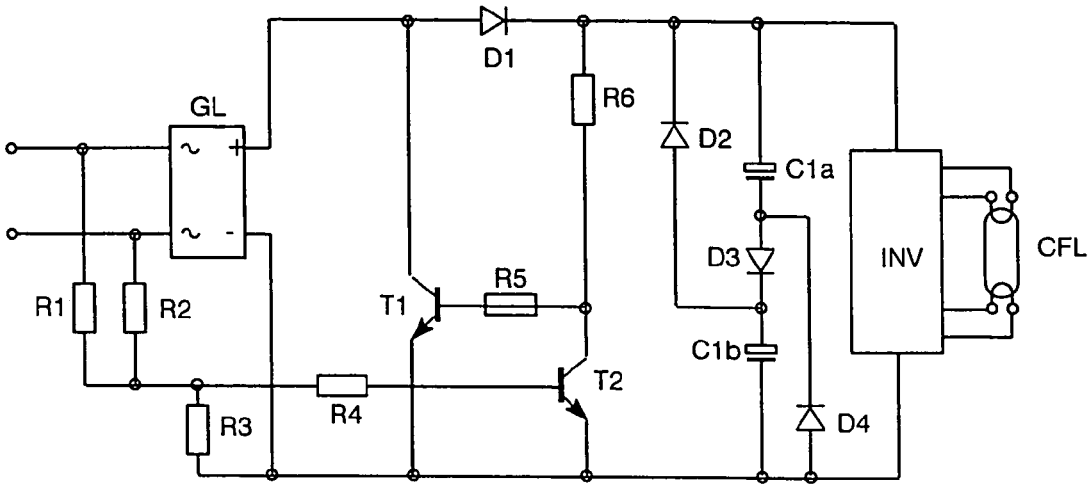
FIG. 4*b* shows a construction of the interface circuit which is similar to FIG. 4*a*, the smoothing capacitor being replaced by a capacitor/diode circuit arrangement.

The interface circuit according to the invention functions independently of the input circuit used for the lamp. FIG. 4*b* shows a variant of the input circuit in which the individual capacitor C1 shown in FIG. 4*a* is replaced by a circuit comprising three diodes D2–D4 and 2 capacitors C1*a*, C1*b* ("2C-3D circuit"). During operation, the two capacitors are charged serially in this (buffer) circuit.

Figure 4C:
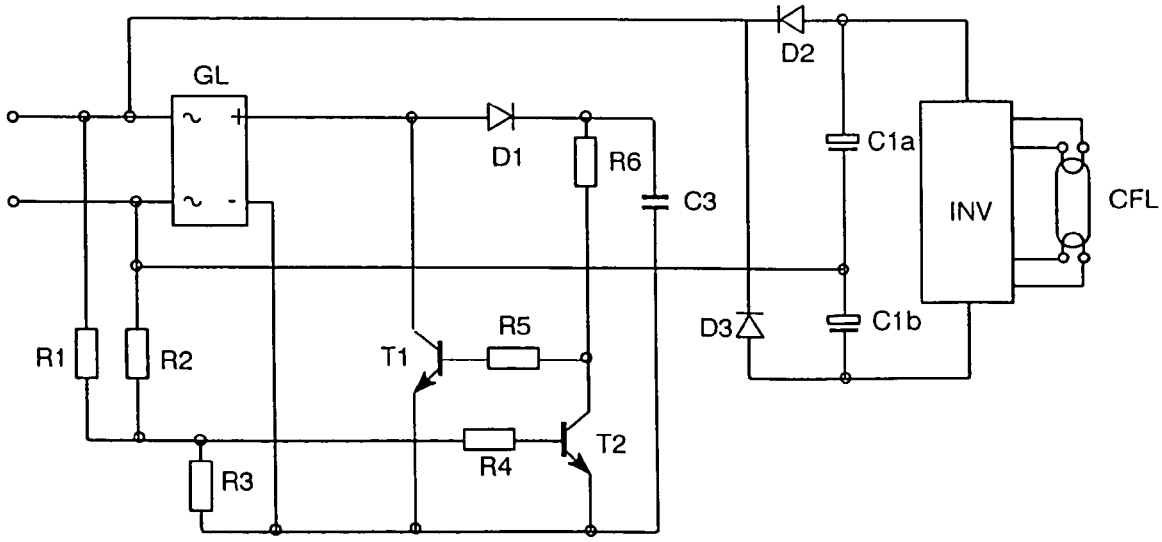
FIG. 4*c* shows an exemplary circuit arrangement for the embodiment according to FIG. 3 in conjunction with a voltage doubler circuit.

If, as shown in FIG. 3, the interface function is intended to be constructed as a separate device IF without a load, it is necessary to feed the current required for switching on the transistor T1 via a resistor from an additional capacitor. In this case, said capacitor may have a relatively low capacitance since it does not have to provide the energy for feeding a load, but rather only the energy for controlling T1 via R6. One example of a circuit of this type is shown in FIG. 4*c*. In this case, the load is connected to the mains via an input circuit which comprises two diodes D2, D3 and two capacitors C1*a*, C1*b* and serves as a "voltage doubler". The interface circuit is connected in parallel therewith and contains a capacitor C3 (mentioned above). In this "voltage doubler" circuit, the capacitors C1*a* and C1*b* are charged alternately (i.e. one by the positive and the other by the negative mains half-cycle) to the peak mains voltage. Thus, overall double the peak mains voltage is available to the load INV, CFL. This circuit can be utilized for example to operate lamps CFL designed for 220 V mains supplies at a 110 V mains (such as e.g. in the USA).

The invention may also be used for controlling the power consumption of a load. For the control of the power consumption of a load (CFL) or for the brightness control of a low pressure discharge lamp (CFL), it is necessary to generate a signal which is proportional to the phase gating angle set at the dimmer and is required as a desired value for example for a regulation of the lamp current in an inverter.

Figure 5:
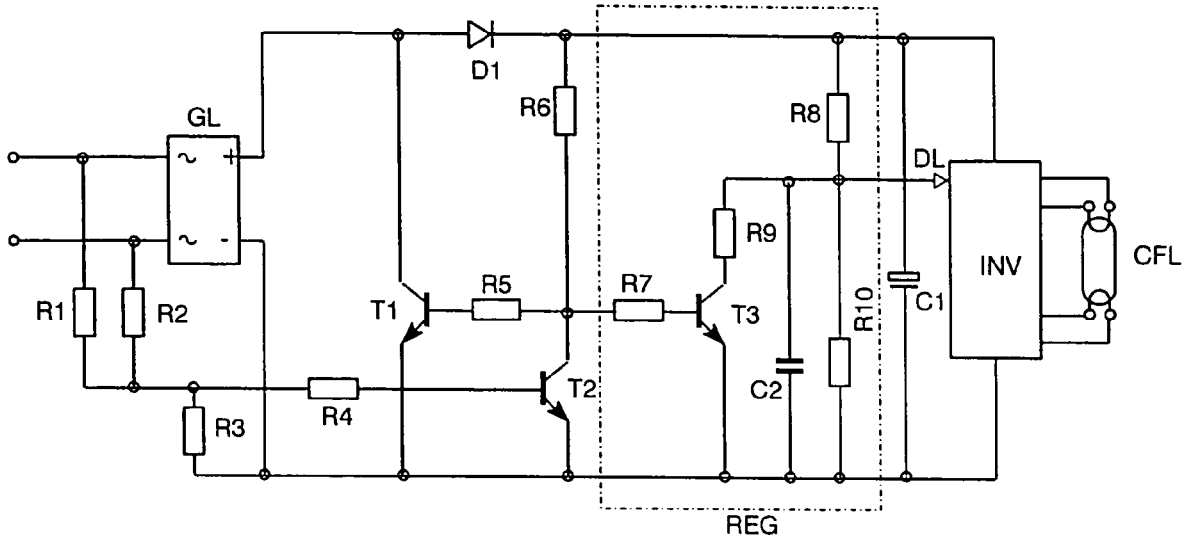
FIG. 5 shows a further circuit arrangement according to the invention with a control circuit (REG) for forming a signal proportional to the phase gating angle of the dimmer.

Preferably, in this case, the magnitude of the desired value is intended to be inversely proportional to the phase gating angle (large desired value for small phase gating angle); in this way, in the case of the arrangement shown in FIG. 5, in the case of "little" dimming (i.e. high brightness in the case of a lamp), a high desired value is obtained, and vice versa. However, it is also possible to generate a directly proportional ratio between phase gating angle and desired value.

According to the invention, said signal is derived from the duty ratio of the transistor T1. This duty ratio corresponds to the ratio of the times ta (triac switched off) and tb (triac partially switched on) within a mains half-cycle (cf. FIG. 2*a*).

An exemplary circuit for realizing this control is shown in FIG. 5. What is shown is an embodiment in which the interface circuit IF (as in FIG. 4) is integrated into the load and is connected between rectifier GL and smoothing capacitor C1. Between interface circuit IF and smoothing capacitor C1, a control circuit REG is connected as part of the interface circuit IF or separately from the latter. The control unit comprises a third transistor T3, the base of which is connected to the collector of the second transistor T2 (via the resistor R7) and which, in series with the resistor R9, is part of a parallel circuit comprising a further smoothing capacitor C2 and a resistor R10. This parallel circuit is connected in series with a further resistor R8, so that this series circuit runs parallel with the smoothing capacitor C2. In order to control the power consumption of the lamp CFL, the voltage drop smoothed by the capacitor C2 is coupled out as control signal DL via a line.

The resistors R7, R8, R9 and R10 and also the smoothing capacitor C2 and the transistor T3 are used to form a DC voltage signal whose magnitude is proportional to the duty ratio ta/tb.

A maximum value for the signal DL forwarded to the inverter INV is defined by the ratio of the resistances of R8 and R10. In the inverter, said signal DL serves as a desired value variable for a regulation or control of the power consumption of the load or the brightness of a lamp CFL. This variable DL can then be processed in the inverter INV e.g. by means of an integrated circuit which correspondingly regulates the power consumption (brightness) of the lamp CFL. The maximum value of DL defined by R8 and R10 defines the maximum power consumption of the load or the maximum brightness of the lamp.

If the transistor T3 is permanently switched on, a minimum value for the signal DL forwarded to the inverter INV is defined by the ratio of the resistance of R8 and the total resistance of the parallel circuit of R10 and R9.

Through the switching of the transistor T3, which corresponds temporarily to that of T1, a DC voltage which is dependent on the duty ratio of T1 and T3 and is smoothed by the capacitor C2 is established for DL. In this case, the resistor R7 serves to improve the switching behavior of T3.

Instead of feeding the signal DL via R8 from the capacitor C1 it is also possible to use a different signal present in the inverter circuit INV, which is not described in any greater detail here.

What is claimed is:

1. An interface circuit for operating a capacitive load from a mains supply circuit, the interface circuit comprising:

a first transistor coupled across an input of the load and operable to activate and thereby effectively short-circuit a supply input of the load, wherein the first transistor includes a base; and a second transistor coupled to the base of the first transistor, and operable to selectively deactivate the first transistor, wherein the second transistor includes a base that is coupled to a respective mains-side input of a rectifier via a first and a second resistor.

2. An interface circuit for operating a capacitive load from a mains supply circuit, the interface circuit comprising:

a first transistor coupled across an input of the load and operable to activate and thereby effectively short-circuit a supply input of the load, wherein the first transistor includes a base;

a second transistor coupled to the base of the first transistor, and operable to selectively deactivate the first transistor, wherein the second transistor includes a base that is coupled to a respective mains-side input of a rectifier via a first and a second resistor; and a control circuit operable to evaluate a signal generated by the mains supply circuit to generate a signal for controlling power consumption of the load, wherein the control circuit includes parallel circuit, a smoothing capacitor, a fourth resistor, and a fifth resistor, wherein the a parallel circuit is a series circuit comprising a third resistor and a third transistor, the third transistor including a base which is connected to the base of the first transistor, the parallel circuit being connected in series with the fifth resistor, wherein a tap of the control signal for controlling power consumption of the load is provided between the fourth resistor and the fifth resistor.

* * * * *